United States Patent [19]

Kirk

[11] 4,060,217

[45] Nov. 29, 1977

[54] CONCRETE FORMS FOR BUILDING A CONCRETE SPILLWAY

[76] Inventor: Donald Kirk, 1903 N. Maize Road, Wichita, Kans. 67212

[21] Appl. No.: 609,671

[22] Filed: Sept. 2, 1975

[51] Int. Cl.[2] ..... B28B 7/22; F02B 5/08; F04C 1/00

[52] U.S. Cl. ..... 249/10; 249/13; 249/5; 249/33; 249/3

[58] Field of Search ..... 249/1, 2, 3, 4, 5, 6, 249/7, 8, 9, 10, 33, 34, 44, 25, 131 Y, 20, 124, 126, 131 S; 264/23

[56] References Cited

U.S. PATENT DOCUMENTS

| | | | |
|---|---|---|---|
| 964,604 | 7/1910 | Babel | 249/33 |
| 1,005,016 | 10/1911 | Fuller | 249/1 X |
| 1,028,294 | 6/1912 | Simpson | 249/4 |
| 1,214,870 | 2/1917 | Zeiser | 249/5 |
| 1,279,059 | 9/1918 | Whiteway et al. | 249/5 X |
| 1,329,177 | 1/1920 | Heltzel | 249/3 |
| 1,374,199 | 4/1921 | Greene | 249/33 |
| 1,382,082 | 6/1921 | Heltzel et al. | 249/6 |
| 1,472,018 | 10/1923 | Heltzel | 249/6 |
| 1,482,700 | 2/1924 | Ratzesberger | 249/5 |
| 1,602,575 | 10/1926 | Franson | 249/40 X |
| 1,739,254 | 12/1929 | Mosel | 249/2 |
| 1,756,514 | 4/1930 | Hempstead | 249/3 |
| 1,833,509 | 11/1931 | Wolf | 249/5 |
| 2,511,584 | 6/1950 | Hill | 249/33 X |
| 2,518,847 | 8/1950 | Youngman | 249/33 X |
| 2,532,246 | 11/1950 | Shuter | 249/34 X |
| 2,661,517 | 12/1953 | Findley | 249/34 |
| 2,845,683 | 8/1958 | Winegar | 249/5 |
| 3,195,852 | 7/1965 | Lundell | 249/34 |
| 3,288,426 | 11/1966 | Simpson | 249/5 X |
| 3,347,514 | 10/1967 | Yates | 249/2 |
| 3,381,929 | 5/1968 | Bancker | 249/5 |
| 3,428,287 | 2/1969 | Redding et al. | 249/2 X |
| 3,453,707 | 7/1969 | Johansson | 264/23 X |

FOREIGN PATENT DOCUMENTS

| | | | |
|---|---|---|---|
| 902,188 | 1/1954 | Germany | 249/10 |

*Primary Examiner*—J. Howard Flint, Jr.
*Attorney, Agent, or Firm*—Edwin H. Crabtree; John H. Widdowson

[57] ABSTRACT

Concrete forms for building a concrete spillway using prefabricated metal concrete forms. The concrete forms being adaptable for building spillways having various widths, heights and lengths. The spillways are used to control water runoff during heavy rains and prevent soil erosion of farm and ranch land.

6 Claims, 9 Drawing Figures

CONCRETE FORMS FOR BUILDING A CONCRETE SPILLWAY

BACKGROUND OF THE INVENTION

This invention relates generally to building structures with concrete and more particularly but not by way of limitation, to prefabricated concrete forms.

Today federal and state agencies work with the farmer and rancher to prevent soil erosion and control water runoff. One method of controlling water runoff is the terracing of a hillside and sloping the terrace toward a dirt canal. The dirt canal is from 100 to 200 feet wide and is seeded with grass. The dirt canal is adequate in controlling water runoff but the canal has to be graded properly and can not be used for farm land. Also it takes a number of years to grow a grass cover. The cost of buying grass seeds, tilling the soil, and planting the grass seed is also expensive and time consuming. Metal culverts are used to control water runoff but very often the culverts are not large enough to control the water flow and the dirt foundation around the culverts is washed away.

It has been found that the use of a concrete spillway to receive the water runoff eleminates the waste of rich farm land used for dirt canals and the cost of and time building the dirt canal. It has been found that by building spillways progressively larger from near the crest of the hill to the bottom of the hill and terracing the hill side into the spillways that water runnoff can be adequately controlled and soil erosion prevented.

Heretofore the concrete spillways have been built using wooden concrete forms. The use of wooden forms is expensive, wasteful, time consuming and requires skilled labor to construct them.

SUMMARY OF THE INVENTION

The subject invention eliminates the need of building individual wooden forms used in the construction of each concrete spillway. The concrete forms disclosed herein are adaptable to the construction of spillways having various dimensions and reduce the time to set up the forms by half.

The concrete form includes metal form plates adjacent to one another for receiving concrete therebetween. The form plates are ridgedly held together by "U" shaped yokes that are slidably attached and bolted to the top of the form plates. The form plates are held against the excavated ground surface by anchor pins attached to the sides of the form plates.

The concrete forms include upper and lower wing wall forms, side wall forms, distilling basin wall forms and upper and lower curb forms. The lengths of the side wall forms, distilling basin forms, and upper and lower curb forms come in various lengths so that the dimensions of the spillway can be varied according to the volume of water required to be controlled.

The advantages and objects of the invention will become evident from the following detailed description when read in conjunction with the accompanying drawings which illustrate the embodiments of the invention.

DETAILED DESCRIPTION OF THE DRAWINGS

Figure 1:
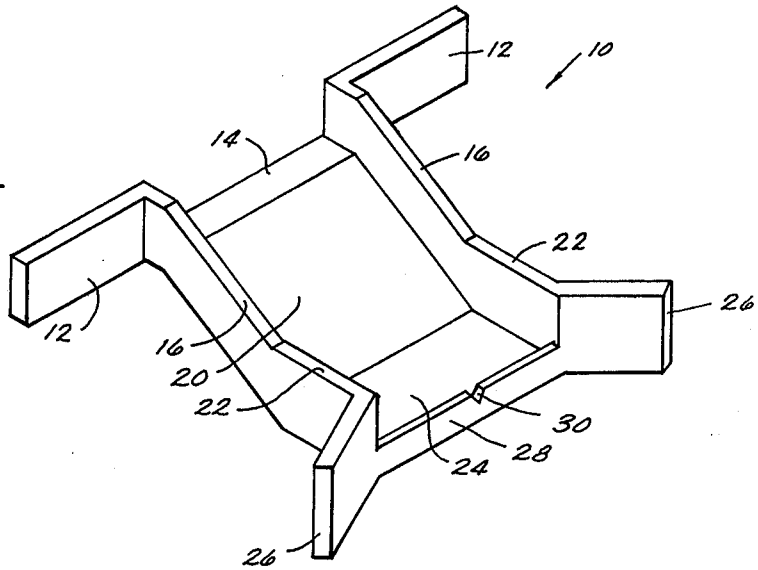
FIG. 1 is a perspective view of the completed concrete spillway.

FIG. 1 illustrates the completed concrete spillway designated by the general reference number 10. The spillway 10 includes upper wing walls 12, upper curb 14, side walls 16, spillway 20, distilling basin walls 22, distilling basin 24, lower wing walls 26 and lower curb 28 with a drain 30.

Figure 2:
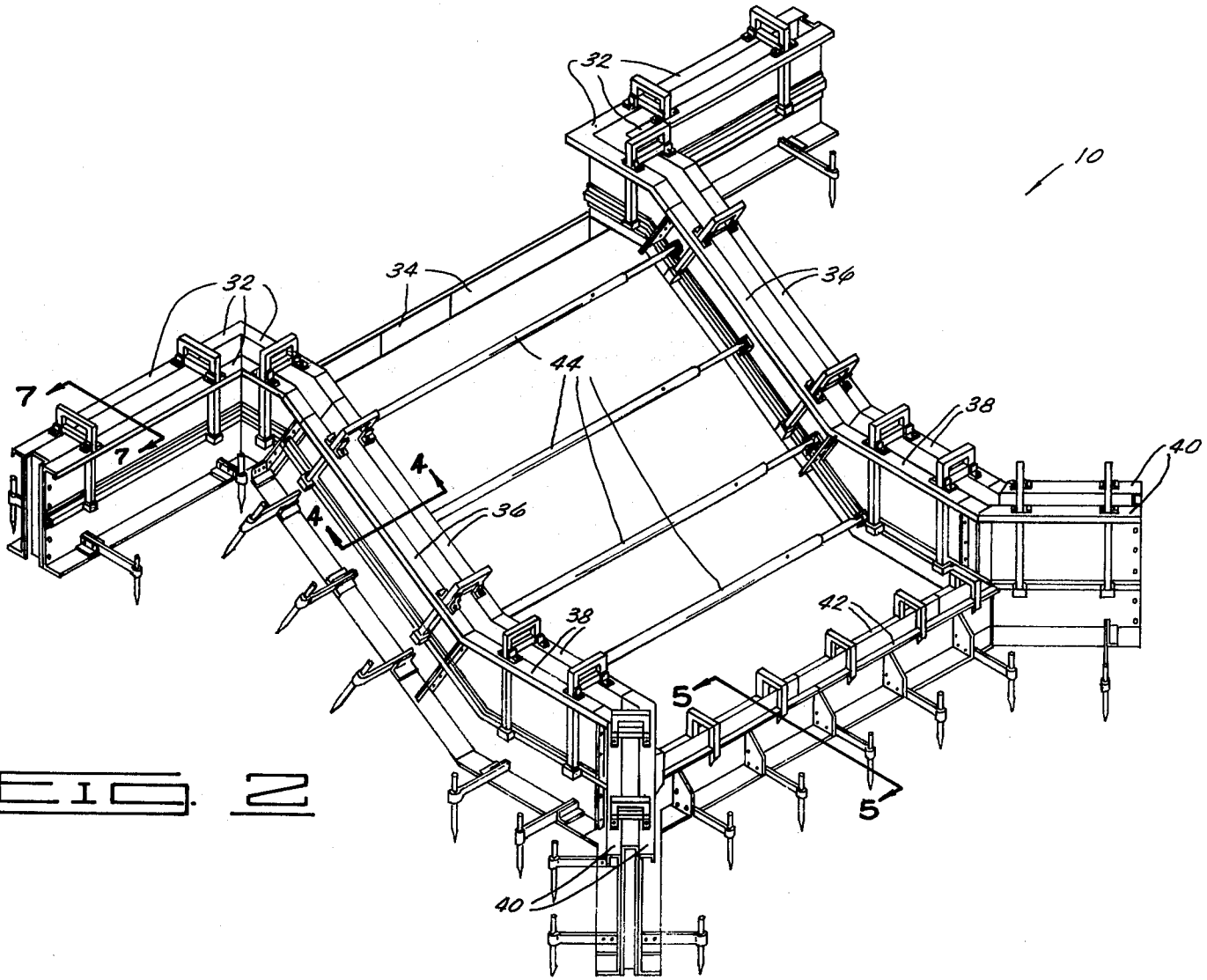
FIG. 2 is a perspective view of the concrete spillway with the concrete forms in place.

FIG. 2 illustrates the spillway 10 with the concrete forms in place prior to the pouring of the concrete. The forms include upper wing wall forms 32, upper curb forms 34, side wall forms 36, distilling basin wall forms 38, lower wing wall forms 40, and lower curb forms 42. The upper curb forms 34 and lower curb forms 42 come in various lengths depending on the required width of the spillway 20. The side wall forms 36 and distilling basin wall forms 38 are held in place by parallel adjustable spreader bars 44 as the walls and spillway are poured.

Figure 3:
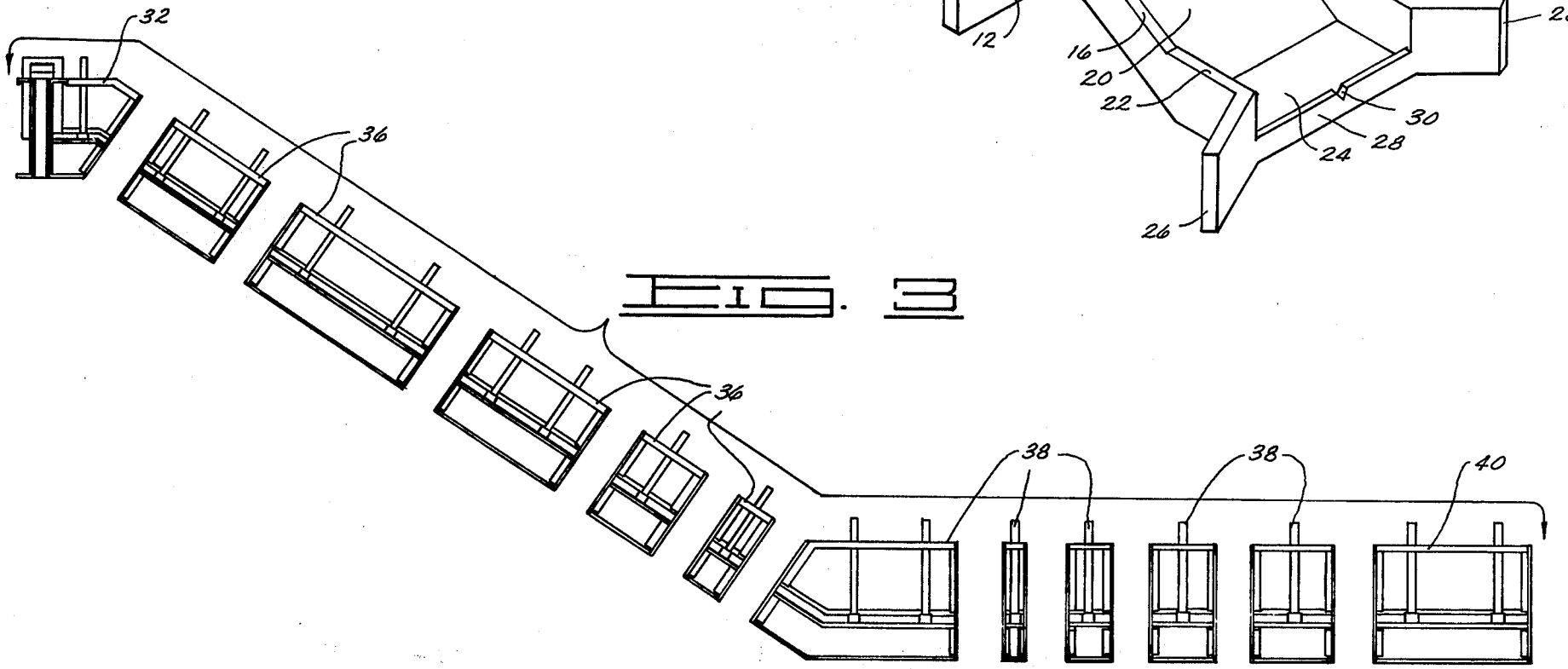
FIG. 3 is a side view of the concrete forms showing the various lengths of the side wall forms and the distilling basin wall forms.

FIg. 3 is a side view of the concrete forms illustrating the various lengths of forms that can be used to determine the length of the spillway 20 and the length of the distilling basin 24. Normally the distance in drop from the upper curb 14 to the distilling basin 24 should be equal to the length of the distilling basin 24 to adequately control the water flow. Upper wing wall forms 32 and lower wing wall forms 40 are standard in length and normally will not vary with the different sizes of the concrete spillway structure. Side wall forms 36 and distilling basin wall forms 38 come in various lengths as shown in this figure and can be combined to form the required lengths of spillway and distilling basin.

Figure 4:
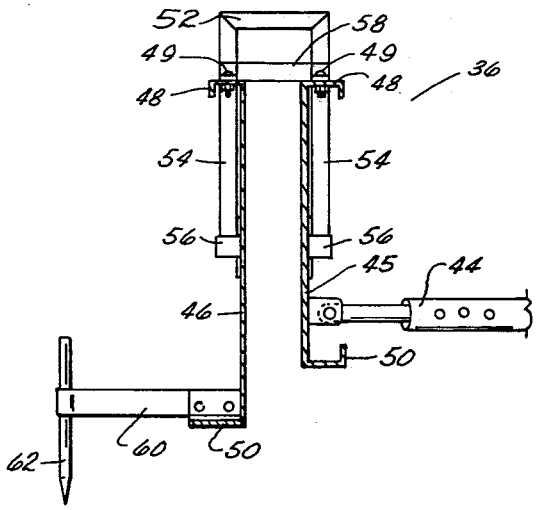
FIG. 4 is a cross section of the side wall form taken along section 4—4 shown in FIG. 2.

FIG. 4 illustrates the novel prefabricated concrete form taken along section 4—4 shown in FIG. 2 of the side wall form 36. The form 36 includes an inner form plate 45 and outer form plate 46 with a top flange portion 48 and bottom flange portion 50. The form plate 45 and 46 are secured in position by a U-shaped yoke 52. The U-shaped yoke 52 is slidably received in an aperture (not shown) in the top flange portion 48 and is bolted thereto with bolts 49. The end portions 54 of the yoke 52 are held against the sides of form plates 45 and 46 by keepers 56. The yoke 52 further includes cross bar 58 to strengthen the yoke 52. The cross bar 58 rests on top of the upper flange portion 48 when the yoke 52 is secured to the form plate 45 and 46. The bottom flange portion 50 of the outer form plate 46 has an anchor arm 60 with anchor pin 62 attached to it for securing the form to the ground surface.

The inner form plate 45 is shown with an adjustable spreader bar 44 attached to its side. The side wall form 36, distilling basin wall form 38 and lower curb form 42 all have an inner form plate similar to inner form plate 45 which is shorter in height than the adjacent outer form plate. This difference is to allow an opening below the inner form plate so that the concrete wall can be formed adjacent to the spillway and distilling basin floor.

Figure 4A:
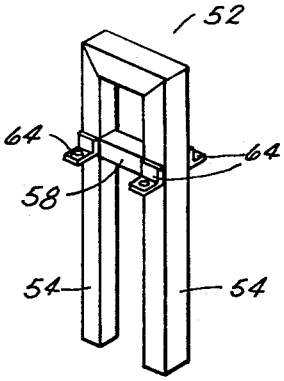
FIG. 4*a* is a perspective view of the U-shaped yoke.

FIG. 4*a* illustrates the U-shaped yoke 52 before the yoke is slidably attached to the form plates 45 and 46. In this view L-shaped brackets 64 can be seen. The bracket 64 is used with bolt 49 to secure the yoke 52 to the upper flange portion 48.

Figure 5:
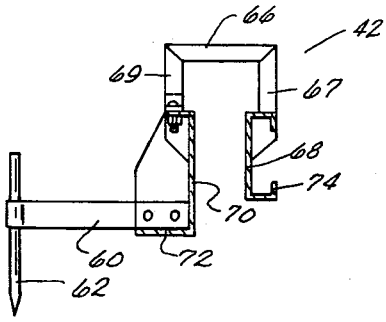
FIG. 5 is a cross section of the lower curb form taken along section 5—5 shown in FIG. 2.

FIG. 5 illustrates the lower curb form 42 taken along section 5—5 shown in FIG. 2. The lower curb form 42 includes a U-shaped yoke 66 with one arm 67 welded to the inner form plate 68. The other arm 69 of the yoke 66 is bolted to an outer form plate 70. The bottom flange portion of outer form plate 70 is secured to an anchor arm 60 with anchor pin 62.

Figure 5A:
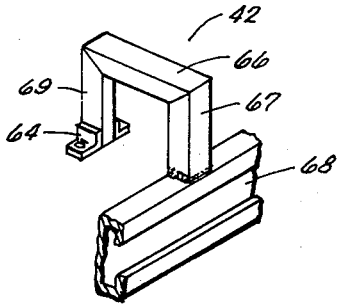
FIG. 5*a* is a perspective view of the U-shaped yoke attached to one of the lower curb form plates.

FIG. 5*a* illustrates the U-shaped yoke 66 with a section of the inner form plate 68 before the yoke is attached to the outer form plate 70. Bracket 64 is similar to those shown in FIG. 4*a* is used with bolt 49 to secure the yoke 66 to the outer form plate 70.

Figure 6:
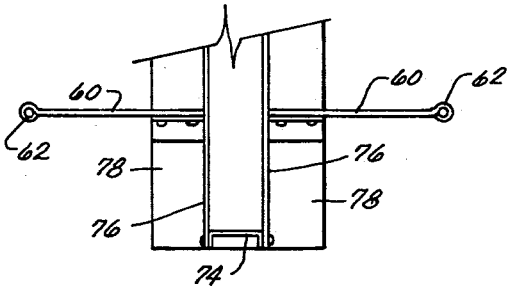
FIG. 6 is a top view of the end portion of either the upper or lower wing wall forms.

FIG. 6 is a top view of an end section of the upper wing wall 32 and lower wing wall form 42. This view is taken below the upper flange portion of the form plates. In this view the header plate 74 is shown attached to the ends of form plate 76. The header 74 prevents the freshly poured concrete from running out the ends of the forms. Attached to the lower flange portion 78 of the form plates 76 is anchor 60 with anchor pin 62.

In using the upper and lower wing wall forms 32 and 44 it should be noted that these forms do not rest against the side of the spillway 70 or the distilling basin 24, therefore, the anchor arm 60 and anchor pin 62 are used on both sides of the form plates to secure the forms to the ground.

Figure 7:
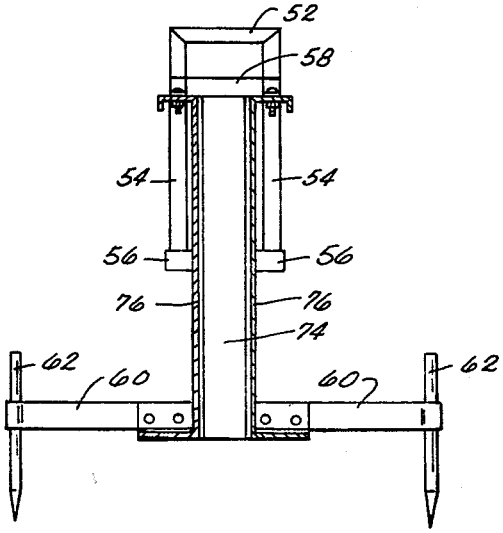
FIG. 7 is a cross section of the upper wing wall form taken along section 7—7 shown in FIG. 2.

FIG. 7 is a sectional view of the upper wing wall form 32 taken along 7—7 shown in FIG. 2. This view illustrates the form plates 76 parallel and adjacent to each other and having the same height. Both of the form plates 76 have the anchor arm 60 and the anchor pin 62 attached.

In operation the construction of the concrete spillway 10 is started by excavating the ground surface in preparation for setting up the concrete forms. The correct width, length and height of the spillway 10 is determined by selecting the correct length or combination of lengths of side wall forms 36, distilling basin wall forms 38, upper curb forms 34 and lower curb forms 42.

The first forms set up are the upper wing wall forms 32 which are anchored to the ground surface. The side wall forms 36 are then bolted to the upper wing wall forms 32. The distilling basin wall forms 38 are now bolted to the side wall forms 36. The lower wing wall forms 40 are then bolted to the distilling basin wall forms 38.

The upper curb forms 34 and the lower curb forms 42 are then placed in position with their ends secured against the sides of the upper wing wall forms 32 and the lower wing walls 42. The forms having anchor pins 62 are anchored to the ground surface. The parallel adjustable spreader bars 44 are attached to the sides of the wall forms 36 and distilling basin wall forms 38 and are adjusted to hold the forms in place while the concrete is poured between the wall forms and while the surface of the spillway and distilling basin are formed.

Changes may be made in the construction and arrangement of the parts or elements of the embodiments as disclosed herein without departing from the spirit or scope of the invention as defined in the following claims.

I claim:

1. A concrete form for use in pouring concrete structures on a ground surface, the concrete form comprising:

form plates adjacent to one another for receiving the concrete therebetween and forming a desired structure, said form plates having outwardly extending flange portions on the top and bottom of said plates and angular shaped keepers mounted on the outer side of said form plates, the top flange portions having apertures therein;

a "U" shaped yoke having a rigid unitary structure and an angular cross-section, said yoke including;

a top portion;

two downwardly extending parallel arms attached at one end to the ends of the top portion, the other ends of the two arms removably inserted into the apertures in the top flange portion of said form plates and therethrough, the other ends of the two arms received in the keepers of said form plates;

"L" shaped brackets extending outwardly from the sides of the arms and having apertures therein for receiving securing means therethrough for securing the arms to the top flange portions of said form plates;

an angular shaped crossbar disposed below and parallel to the top portion of said yoke, the ends of the crossbar attached to the arms of said yoke, the crossbar resting on the top flange portion of said form plates when said yoke is slidably received in said form plates; and anchor arms and anchor pins, said anchor arms having one end attached to the bottom flange portion of said form plates, the other end of said anchor arms attached to said anchor pins, said anchor pins driven into the ground surface.

2. The form as described in claim 1, further including form plate headers attached to the ends of said form plates to prevent concrete from running out the end of said form plates.

3. The form as described in claim 1, further including a spreader bar attached to one of said form plates, said spreader bar keeping the concrete forms equally spaced from one another when concrete is poured.

4. The form as described in claim 1, wherein one of said form plates is shorter in height than said adjacent form plate, said shorter form plate providing an opening at the bottom thereof so that the concrete poured between said form plates is adjacent to a floor structure extending outwardly from beneath said shorter form plate.

5. A concrete form for use in pouring concrete structure on a ground surface, the concrete form comprising:

form plates adjacent to one another for receiving the concrete therebetween and forming a desired structure, said form plates having outwardly extending flange portions at the top and bottom of said plates, one of said form plates being shorter in height than said adjacent form plate, said shorter form plate providing an opening at the bottom thereof so that the concrete poured between said form plates is adjacent to a floor structure extending outwardly from beneath said shorter form plate the top flange portion of said longer form plate having an aperture therein;

a "U" shaped yoke having a rigid unitary structure and an angular cross section, one of the arms of said yoke removably inserted into the aperture in the top flange portion of said longer form plate, the arm having an "L" shaped bracket extending outwardly therefrom and having an aperture therein for recieving securing means therethrough for securing the arm to the top flange portion of the longer form plate, the end of the arm received in an angular shaped keeper mounted on the outer side of said longer formed plate, the other arm of said yoke welded to the top flange portion of said shorter formed plate; and 1 an anchor arm and anchor pin, said anchor arm having one end attached to the bottom flange portion of said longer form plate, the other end of said anchor arm attached to said anchor pin, said anchor pin driven into the ground surface.

6. The form as described in claim 5, wherein said yoke extends upwardly above the top flange portions of said form plates so that said yoke does not contact the concrete structure when poured to the top of said form plates.

* * * * *